US011686268B2

(12) United States Patent
Sakata et al.

(10) Patent No.: US 11,686,268 B2
(45) Date of Patent: Jun. 27, 2023

(54) INTERNAL COMBUSTION ENGINE CONTROL METHOD AND CONTROL DEVICE

(71) Applicant: NISSAN MOTOR CO., LTD., Yokohama (JP)

(72) Inventors: Tomohiro Sakata, Kanagawa (JP); Taiichiro Sugano, Kanagawa (JP)

(73) Assignee: NISSAN MOTOR CO., LTD., Yokohama (JP)

( * ) Notice: Subject to any disclaimer, the term of this patent is extended or adjusted under 35 U.S.C. 154(b) by 22 days.

(21) Appl. No.: 17/613,610

(22) PCT Filed: May 24, 2019

(86) PCT No.: PCT/IB2019/000633
§ 371 (c)(1),
(2) Date: Nov. 23, 2021

(87) PCT Pub. No.: WO2020/240244
PCT Pub. Date: Dec. 3, 2020

(65) Prior Publication Data

US 2022/0235722 A1 Jul. 28, 2022

(51) Int. Cl.
*F02D 41/30* (2006.01)
*F02D 41/04* (2006.01)

(52) U.S. Cl.
CPC ..... *F02D 41/3094* (2013.01); *F02D 41/047* (2013.01); *F02D 2200/0406* (2013.01); *F02D 2200/0606* (2013.01); *F02D 2200/101* (2013.01); *F02D 2250/00* (2013.01)

(58) Field of Classification Search
CPC .... F02D 41/3094; F02D 41/047; F02D 41/04; F02D 15/02; F02D 2200/0406; F02D 2200/0606; F02D 2200/101; F02D 2250/00; F02M 2200/248
USPC ..... 123/435, 431, 299, 300; 701/103–105, 701/107, 111
See application file for complete search history.

(56) References Cited

FOREIGN PATENT DOCUMENTS

JP 2009-197705 A 9/2009

*Primary Examiner* — Hai H Huynh
(74) *Attorney, Agent, or Firm* — Foley & Lardner LLP

(57) ABSTRACT

A control method of an internal combustion engine including an in-cylinder injection fuel injection valve arranged to inject a fuel to a combustion chamber, and a port injection fuel injection valve arranged to inject the fuel to an intake port, the control method includes: sensing or estimating a fuel temperature at a tip end portion of the in-cylinder injection fuel injection valve; sensing an intake pressure; judging whether or not a flash boiling condition based on the fuel temperature and the intake pressure; setting the in-cylinder fuel injection valve to a default fuel injection valve; and injecting an entire or a part of the fuel from the port injection fuel injection valve by decreasing an injection amount ratio of the in-cylinder injection fuel injection valve when the flash boiling condition is satisfied.

6 Claims, 11 Drawing Sheets

INTERNAL COMBUSTION ENGINE CONTROL METHOD AND CONTROL DEVICE

TECHNICAL FIELD

This invention relates to a control method and a control device of an internal combustion engine including an in-cylinder injection fuel injection valve configured to inject fuel to a combustion chamber, and a port injection fuel injection valve configured to inject the fuel to an intake port, which are configured to control fuel injection amount ratios of the in-cylinder injection fuel injection valve and the port injection fuel injection valve.

BACKGROUND ART

A patent document 1 discloses an internal combustion engine including an in-cylinder injection fuel injection valve configured to inject fuel to a combustion chamber, and a port injection fuel injection valve configured to inject the fuel to an intake port.

In the patent document 1, when a temperature of a piston on which the fuel spray injection injected from the in-cylinder injection fuel injection valve is injected is low, the injection amount ratio by the port injection fuel injection valve is increased so as to decrease the PM (Particulate Matter) and the PN (Particulate Number) which are performance indexes of the exhaust particulate included in the exhaust air. After the warning-up at which the piston temperature becomes high, the fuel is basically injected into the combustion chamber by the in-cylinder injection fuel injection valve.

A following new knowledge was obtained by investigation of inventors of the present invention. In a case where the fuel temperature just before an injection hole is higher than a predetermined temperature, when the fuel of the high temperature and the high pressure is exposed though the injection hole to the low pressure, the instantaneous boiling of the fuel, that is, "flash boiling" is generated, so that the PN is increased. That is, in a case where the flash boiling is generated, at least a part of the fuel is vaporized and expanded at the moment when the fuel exits from the injection hole. The respective sprays injected in thin conical shapes from the injection holes tend to be expand in the bold shapes. Accordingly, the adhesion of the fuel liquid film on the tip end portion (a portion around the outlet of the injection hole) of the fuel injection valve (that is, the wet of the tip end portion of the fuel injection valve by the fuel) which is generated at the end of the injection is increased, so that PN is increased.

The patent document 1 does not utterly consider this deterioration of the PN by the flash boiling in the in-cylinder injection fuel injection valve.

PRIOR ART DOCUMENT

Patent Document

Patent Document 1: Japanese Patent Application Publication No. 2009-197705

SUMMARY OF THE INVENTION

In the present invention, a control method comprises sensing or estimating a fuel temperature at a tip end portion of the in-cylinder injection fuel injection valve; sensing an intake pressure; judging whether or not a flash boiling condition in which a flash boiling condition may be generated is satisfied, based on the fuel temperature and the intake pressure; and injecting an entire or a part of the fuel from the port injection fuel injection valve by decreasing an injection amount ratio of the in-cylinder injection fuel injection valve when the flash boiling condition is satisfied.

In this way, when the flash boiling condition in which the flash boiling may be generated is satisfied, the injection amount ratio of the in-cylinder injection fuel injection valve is decreased. With this, the PN becomes smaller relative to, for example, a case where the entire necessary amount of the fuel is supplied from the in-cylinder injection fuel injection valve.

DESCRIPTION OF EMBODIMENTS

Figure 1:
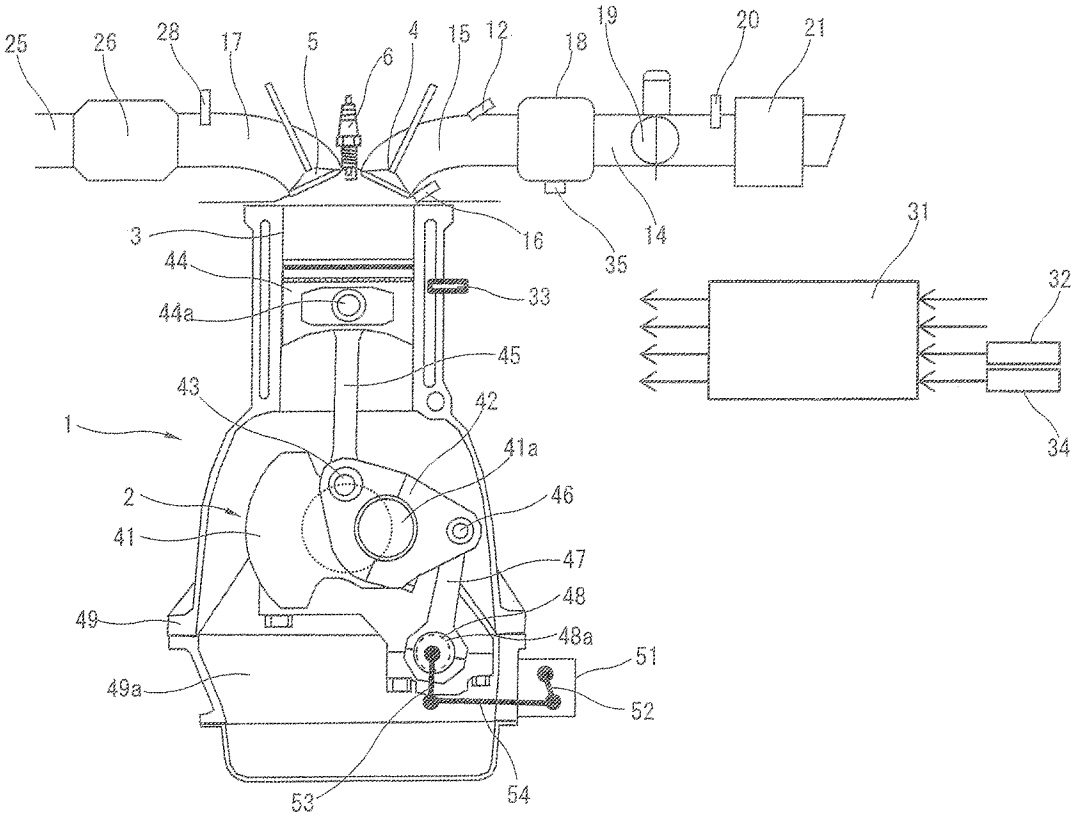
FIG. 1 is a view showing a system configuration of an internal combustion engine according to one embodiment of the present invention.

Hereinafter, an embodiment according to the present invention is explained in detail.

This internal combustion engine 1 is a four stroke cycle spark ignition internal combustion engine including a variable compression ratio mechanism 2 using, for example, a multi-link piston crank mechanism. The internal combustion engine 1 includes a pair of intake valves 4 and a pair of exhaust valves 5 disposed on a ceiling wall surface of a combustion chamber 3; and a spark plug 6 disposed at a central portion surrounded by the intake valves 4 and the exhaust valves 5.

An in-cylinder injection fuel injection valve 16 is disposed at a lower portion of an intake port 15 arranged to be opened and closed by one of the intake valves 4. The in-cylinder injection fuel injection valve 16 is a main fuel injection valve arranged to inject the fuel directly into the combustion chamber 3. Moreover, port injection fuel injection valves 12 are disposed, respectively, to the intake ports 15 of each of the cylinders (that is, toward the intake valve 4). Each of the port injection fuel injection valves 12 is an auxiliary fuel injection valve arranged to inject the fuel into one of the intake ports 7 under a specific condition (predetermined condition) Each of the in-cylinder injection fuel injection valves 16 and the port injection fuel injection valves 12 is an electromagnetic injection valve or a piezoelectric injection valve arranged to be opened by being applied with a driving pulse signal, and to inject the fuel of the amount which is substantially proportional to a pulse width of the driving pulse signal.

An electrically controlled throttle valve 19 is disposed on an upstream side of a collector portion 18 in an intake passage 14 connected to the intake port 15. An opening degree of the electrically controlled throttle valve 14 is controlled by a control signal from the engine controller 31. An air flow meter 20 is disposed on an upstream side of the electrically controlled throttle valve 19. The air flow meter 20 is arranged to sense an intake air amount. An air cleaner 21 is disposed on an upstream side of the air flow meter 20.

Moreover, a catalyst device 26 constituted by a three-way catalyst is disposed on an exhaust passage 25 connected to the exhaust port 17. An air-fuel ratio sensor 28 is disposed on an upstream side of the catalyst device 26. The air-fuel ratio sensor 28 is arranged to sense an air fuel ratio.

The engine controller 31 receives detection signals of sensors such as the air flow meter 20, the air-fuel ratio sensor 28, a crank angle sensor 32 arranged to sense an engine speed, a water temperature sensor 33 arranged to sense a cooling water temperature, an accelerator opening degree sensor 34 arranged to sense a depression amount of an accelerator pedal operated by a driver, a vehicle speed sensor 24 arranged to sense a vehicle speed, and an intake pressure sensor 35 arranged to sense a pressure within the collector portion 18. The engine controller 31 is configured to appropriately control the fuel injection amounts and the injection timings of the fuel injection valves 16 and 12, the ignition timing by the ignition plug 6, the opening degree of the throttle valve 19, and so on, based on the above-described detection signals.

On the other hand, the variable compression ratio mechanism 2 uses a known multiple link piston crank mechanism. The variable compression ratio mechanism 2 includes a lower link 42 rotatably supported by a crank pin 41*a* of a crank shaft 41; an upper link 45 connecting an upper pin 43 of a first end portion of the lower link 42, and a piston pin 44*a* of the piston 44; a control link 47 including a first end connected to a control pin 46 of a second end portion of the lower link 42; and a control shaft 48 swingably supporting a second end portion of the control link 47. The crank shaft 41 and the control shaft 48 are rotatably supported through a bearing configuration within a crank case 49*a* of a lower portion of a cylinder block 49. The control shaft 48 includes an eccentric shaft portion 48*a* arranged to vary a position thereof in accordance with the rotation of the control shaft 48. The control shaft 48 is rotatably mounted on the eccentric shaft portion 48*a*. In this variable compression ratio mechanism 2, the upper dead position of the piston 44 is displaced in the upward and downward direction in accordance with the rotation of the control shaft 48, so that the mechanical compression ratio is varied.

Moreover, in this embodiment, an electric actuator 51 is disposed on an outer wall surface of the crank case 49*a*. The electric actuator 51 is a driving mechanism arranged to variably control the compression ratio of the variable compression ratio mechanism 2. The electric actuator 51 includes a rotation center axis parallel to the crank shaft 41. The electric actuator 51 and the control shaft 48 are linked through a first arm 52, a second arm 53, and an intermediate link 54. The first arm 52 is fixed to an output rotation shaft of the electric actuator 51. The second arm 53 is fixed to the control shaft 48. The intermediate link 54 connects the first arm 51 and the second arm 53. The electric actuator 51 includes an electric motor and a shift mechanism disposed in series in the axial direction. This electric actuator 51 is controlled by a control signal from the engine controller 31 to attain a target compression ratio in accordance with the engine driving condition. Basically, the target compression ratio is the high compression ratio on the low load side. The target compression ratio becomes the lower compression ratio as the load becomes higher, so as to suppress the knocking and so on.

Besides, in the present invention, the variable compression ratio mechanism 2 is not necessary. It may be a fixed compression ratio internal combustion engine.

Figure 2:
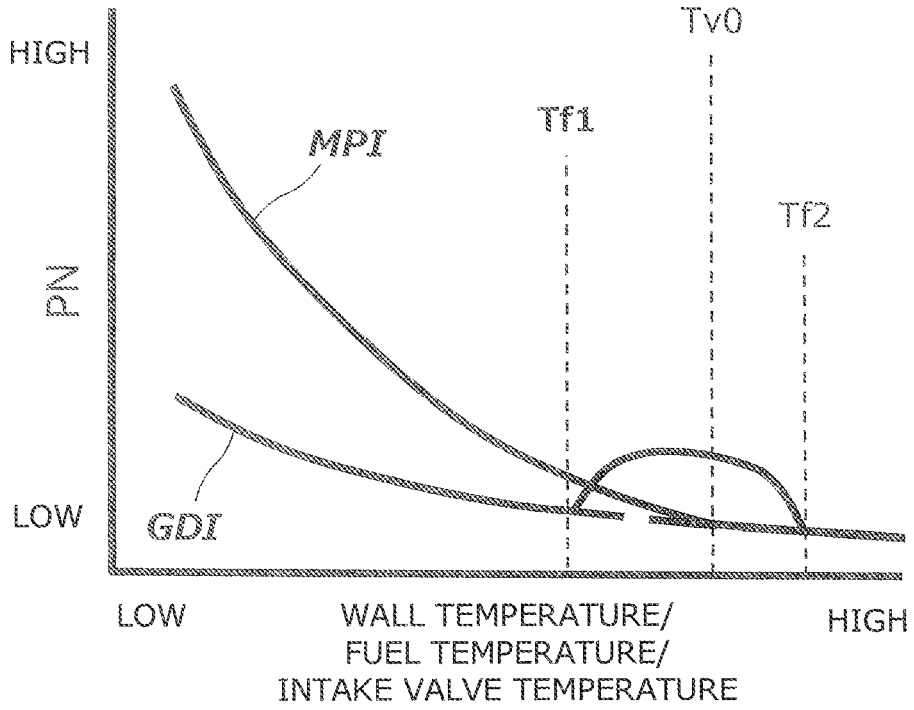
FIG. 2 is a characteristic view showing a comparison between a PN characteristic by a GDI, and a PN characteristic by an MPI.

Next, FIG. 2 is a characteristic view showing a comparison between the PN characteristics of the fuel injection by the in-cylinder injection fuel injection valve 16 (referred to as GDI), and the fuel injection by the port injection fuel injection valve 12 (hereinafter, referred to as MPI). This drawing is a conceptual explanation view. This is not strictly shown. A longitudinal axis is the PN. A transverse axis is wall temperatures of respective portions, the fuel temperature (the fuel temperature at a tip end portion of the in-cylinder injection fuel injection valve 16 described later), and the temperature of the intake valve 4. The transverse axis shows only high and low tendencies of the three temperatures. Accordingly, the same point on the transverse axis does not represent that the three temperatures are same.

As shown in the drawing, in either of the GDI and the MPI, the PN is higher as the wall temperature is lower. The PN becomes lower as the wall temperature is increased. In comparison between the GDI and the MPI, the PN of the MPI is higher as long as the wall temperature is not sufficiently high. When the temperature of the intake valve 4 exceeds a predetermined temperature (intake valve threshold temperature Tv0), there is no significant difference between the values of the PN of the GDI and the MPI.

In this case, in a case where the fuel temperature at the tip end portion of the in-cylinder injection fuel injection valve 16 exceeds a predetermined temperature (flash boiling lower limit temperature Tf1), the flash boiling which is the instantaneous boiling of the fuel is easy to be generated. When the flash boiling is generated, the fuel liquid film is adhered on a portion around the outlet of the injection hole, so that the PN is deteriorated by this fluid film. That is, when the flash boiling is generated, the PN value by the GDI becomes higher than the PN value by the MPI, as shown in FIG. 2.

When the fuel temperature at the tip end portion of the in-cylinder injection fuel injection valve 16 is further increased, that is, when the fuel temperature at the tip end portion of the in-cylinder injection fuel injection valve 16 exceeds a flash boiling upper limit temperature Tf2, the fuel liquid film around the outlet of the injection hole is rapidly evaporated even when the flash boiling which is the instantaneous boiling of the fuel is generated, since the temperature at the tip end portion of the in-cylinder injection fuel injection valve 16 becomes high. Accordingly, the deterioration of the PN due to the flash boiling is not generated.

That is, in a case where the fuel temperature of the tip end portion of the in-cylinder injection fuel injection valve 16 is between the flash boiling lower limit temperature Tf1 and the flash boiling upper limit is temperature Tf2, the deterioration of the PN due to the flash boiling is generated. Consequently, in this case, the MPI is advantageous in the PN suppression relative to the GDI. In particular, when the temperature of the intake valve 4 exceeds the intake valve threshold temperature Tv0, the PN value by the MPI is the sufficient low value. Accordingly, the MPI is advantageous in the PN suppression, irrespective of the influence by the flash boiling.

Figure 3:
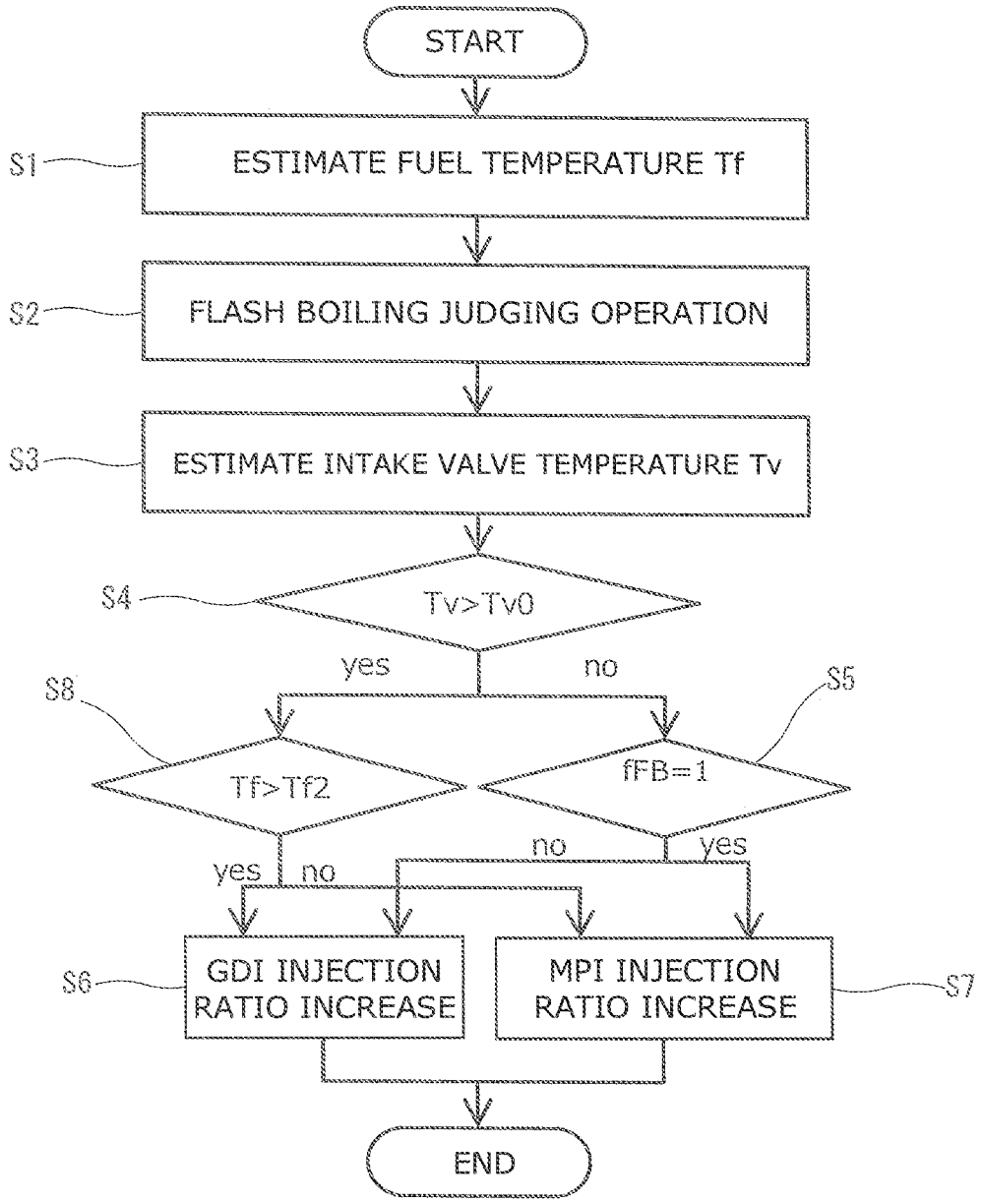
FIG. 3 is a flowchart showing a flow of a control of injection amount ratios of the GDI and the MPI.
Figure 4:
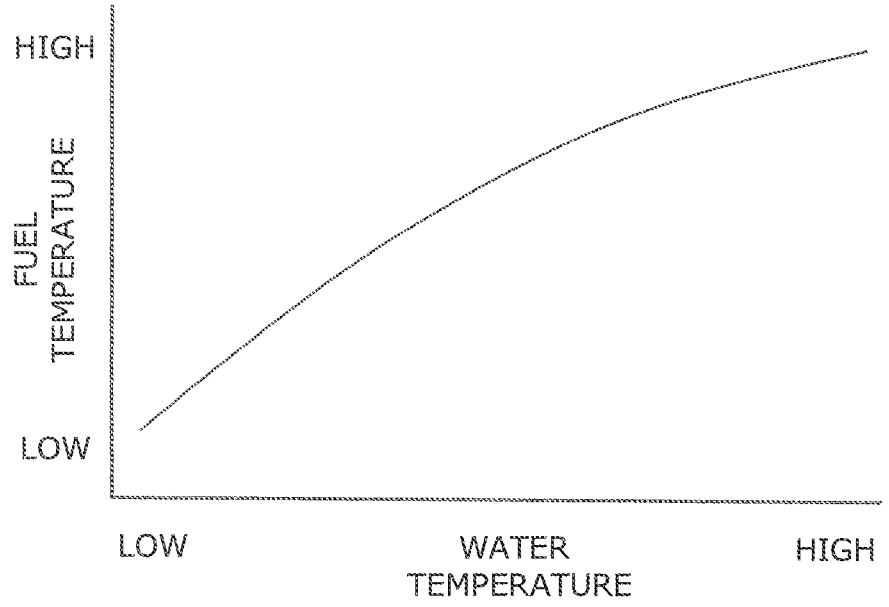
FIG. 4 is a characteristic view showing a relationship between a cooling water temperature and a fuel temperature.
Figure 5:
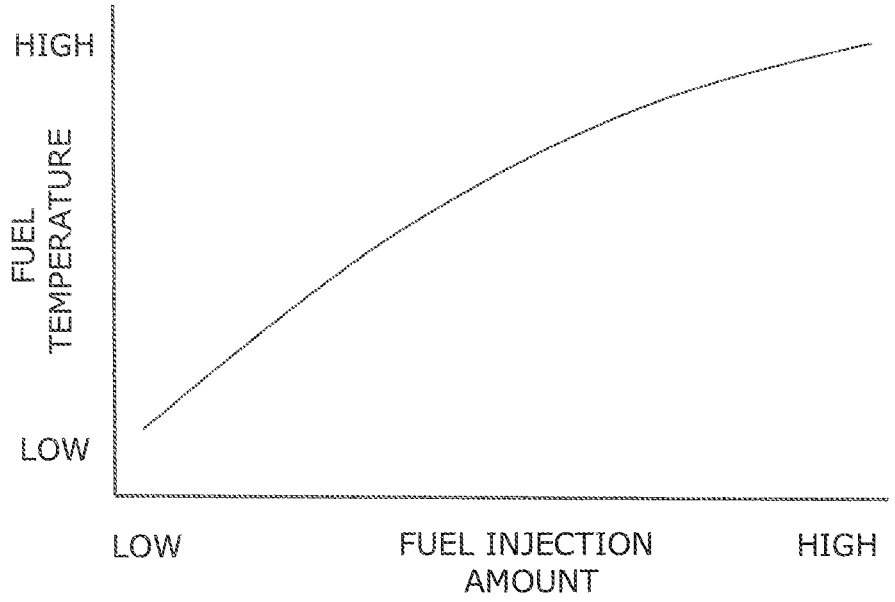
FIG. 5 is a characteristic view showing a relationship between a fuel injection amount and the fuel temperature.
Figure 6:
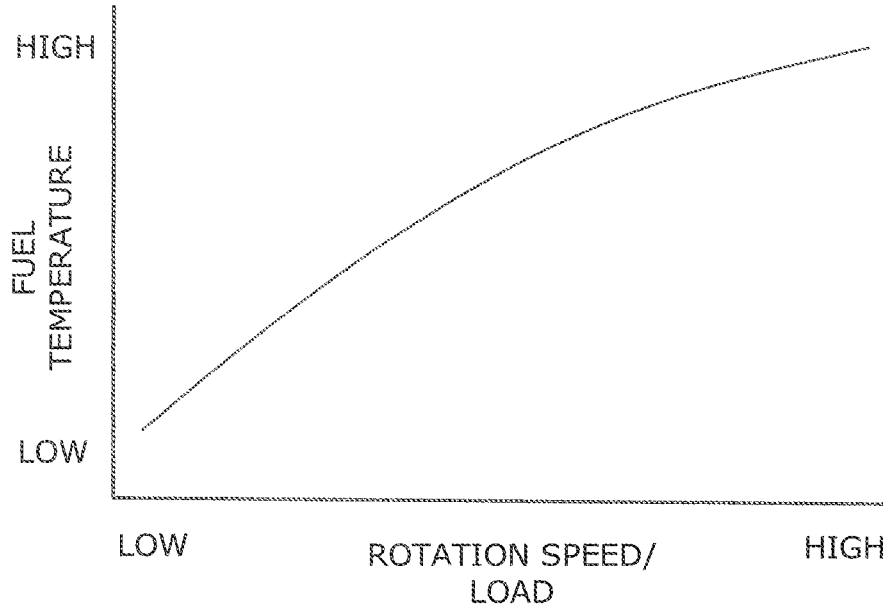
FIG. 6 is a characteristic view showing a relationship between a rotation speed or a load, and the fuel temperature.
Figure 7:
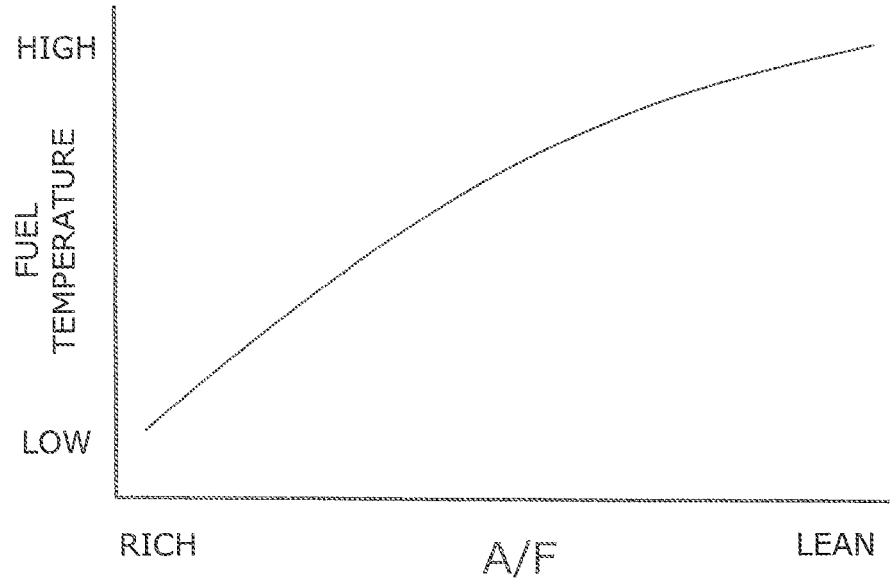
FIG. 7 is a characteristic view showing a relationship between an air fuel ratio and the fuel temperature.

FIG. 3 is a flowchart showing a flow of the control of the injection amount ratios of the GDI and the MPI which is performed in the engine controller 31. Hereinafter, the injection amount ratio of the in-cylinder injection fuel injection valve 16 is referred to as a GDI injection ratio. The injection amount ratio of the port injection fuel injection valve 12 is referred to as an MPI injection ratio. When the in-cylinder injection fuel injection valve 16 injects the necessary entire amount of the fuel, the GDI injection ratio is 100(%), and the MPI injection ratio is 0(%). Conversely, when the port injection fuel injection valve 12 injects the necessary entire amount of the fuel, the GDI injection ratio is 0(%), and the MPI injection ratio is 100(%). In the transition in which the condition is varied, the ratio becomes the intermediate values such as "90:10", "80:20", . . . "20:80", "10:90". Besides, the summation of the GDI injection ratio and the MPI injection ratio may not be necessarily 100(%). However, in the following explanations, the summation becomes simply 100(%) for simplifying the explanations.

The routine shown in the flowchart of FIG. 3 is repeatedly performed at each combustion cycle of each cylinder. At step 1, the fuel temperature, that is, the fuel temperature Tf at the tip end portion of the in-cylinder injection fuel injection valve 16 is estimated (calculated) from the various parameters at this time. For example, the fuel temperature is estimated by using at least one of the cooling water temperature, the fuel injection amount (corresponding to an input heat amount at each cycle), the engine speed, the engine load, and the air fuel ratio which relate to the fuel temperature. FIG. 4 to FIG. 7 show relations between the respective parameters and the fuel temperature Tf. The fuel temperature becomes higher as the cooling water temperature, the fuel injection amount, or the load becomes higher. Moreover, the heat amount per unit time becomes higher as the rotation speed becomes higher. Accordingly, it is estimated that the fuel temperature becomes higher as the rotation speed becomes higher. Moreover, when the air fuel ratio is rich, the combustion temperature is lowered. Consequently, it is estimated that the fuel temperature becomes lower as the air fuel ratio becomes richer. In one example, a basic value of the fuel temperature is determined by using a map previously prepared from the cooling water temperature and the fuel injection amount (or the load). The basic value is corrected by the engine speed and the air fuel ratio. With these, the fuel temperature Tf is estimated.

Subsequently to step 1, at step 2, the intake pressure (the intake negative pressure) sensed by the intake pressure sensor 35 is read. A flash boiling judging operation is performed based on the intake pressure and the fuel temperature Tf estimated at step 1.

Figure 8:
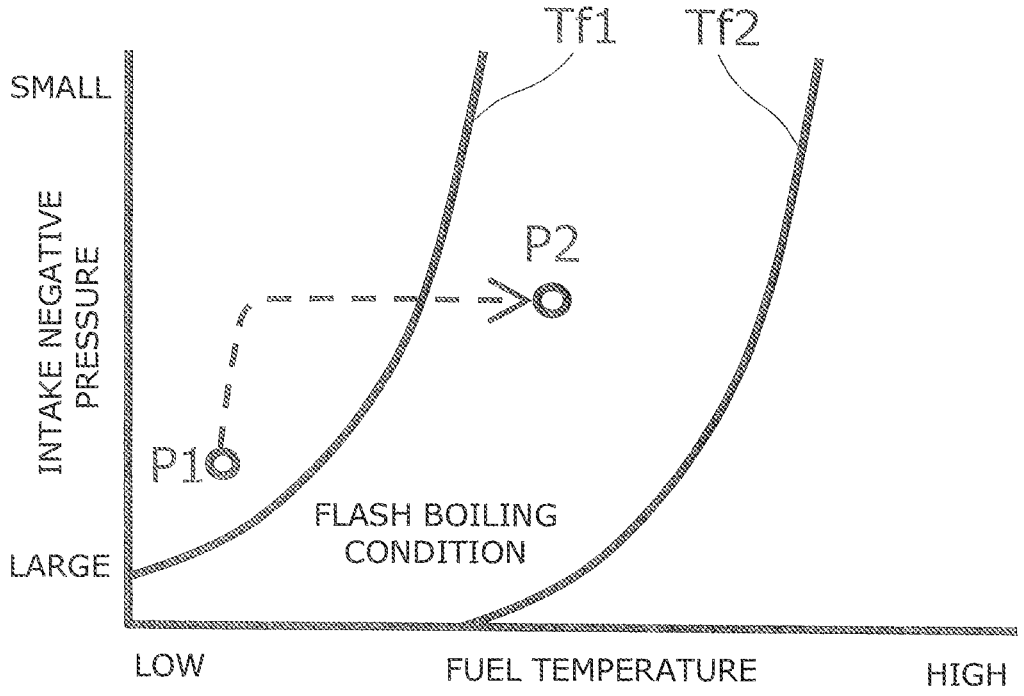
FIG. 8 is a characteristic view showing characteristics of a flash boiling lower limit temperature Tf1 and a flash boiling upper limit temperature Tf2 with respect to an intake negative pressure.
Figure 9:
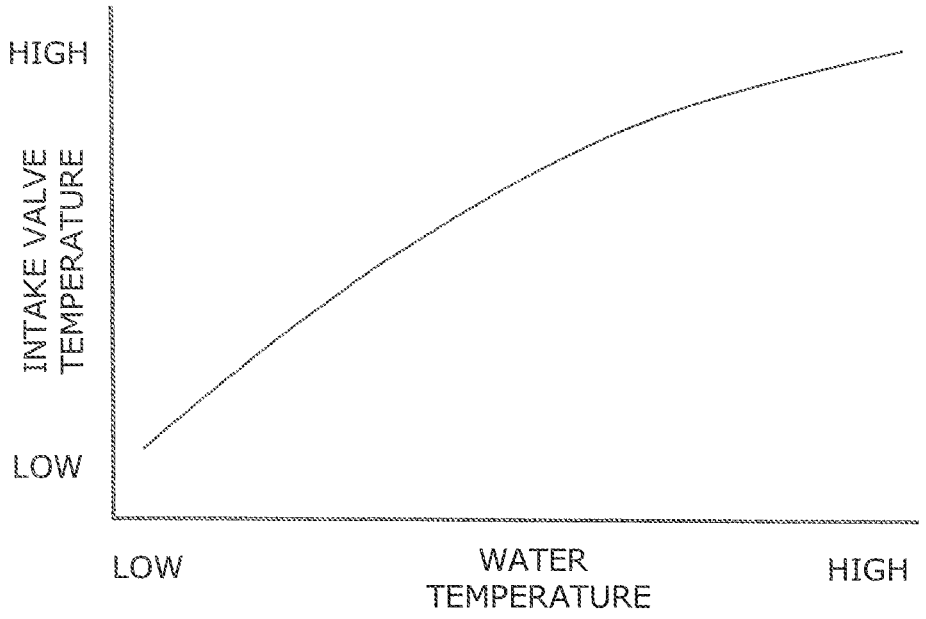
FIG. 9 is a characteristic view showing a relationship between the cooling water temperature and the intake valve temperature.
Figure 10:
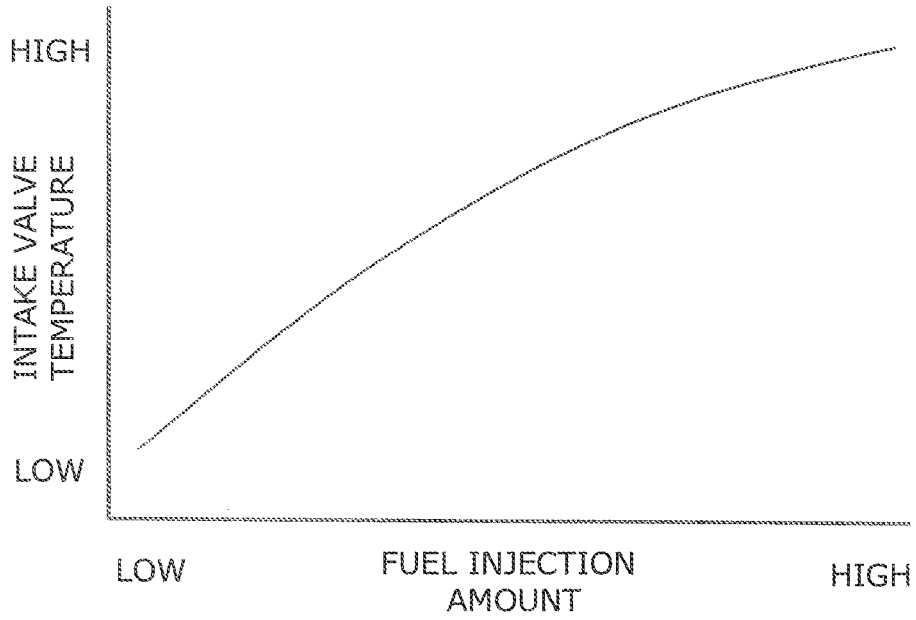
FIG. 10 is a characteristic view showing a relationship between the fuel injection amount and the intake valve temperature.
Figure 11:
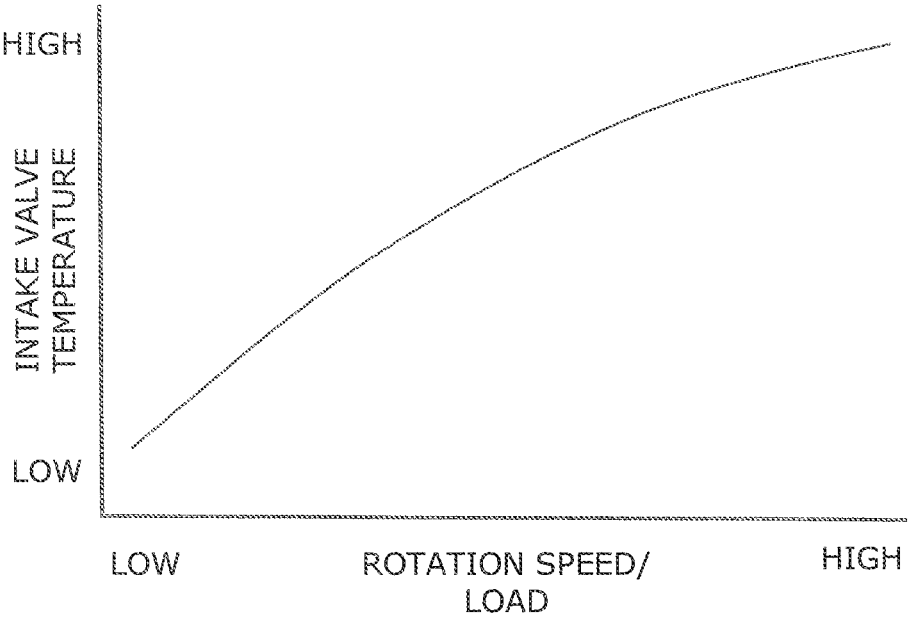
FIG. 11 is a characteristic view showing a relationship between the rotation speed or the load, and the intake valve temperature.

FIG. 8 is a characteristic view showing whether or not the flash boiling which is the phenomenon where the fuel is instantaneously boiled and vaporized when the pressurized fuel is outputted from the injection hole to the combustion chamber 3 that is a relatively low pressure space is generated, based on the intake pressure (the intake negative pressure), and the fuel temperature Tf just before the injection hole (that is, the tip end portion of the in-cylinder injection fuel injection valve 16). As shown in FIG. 8, when the fuel temperature Tf at the tip end portion of the in-cylinder injection fuel injection valve 16 is higher than the flash boiling lower limit temperature shown by a solid line Tf1, at least a part of the fuel is instantaneously boiled and evaporated when the fuel passes through the injection hole to be exposed to the cylinder pressure (cylinder inner pressure). That is, the flash boiling is generated. In this case, the flash boiling lower limit temperature Tf1 becomes lower as the cylinder pressure becomes lower. That is, the flash boiling lower limit temperature Tf1 which is the fuel temperature at which the flash boiling may be generated is a function of the cylinder pressure. Moreover, the intake valve 4 is opened in the intake process. Accordingly, it is possible to consider that the cylinder pressure relating to the flash boiling is substantially identical to the intake pressure. Besides, the intake pressure of the longitudinal axis is shown as the intake negative pressure.

A solid line Tf2 in FIG. 8 shows the above-described flash boiling upper limit temperature Tf2. As described above, the flash boiling upper limit temperature Tf2 is a temperature region in which it is considered that the fluid film generated around the injection hole due to the flash boiling is rapidly evaporated so that the deterioration of the PN due to the flash boiling is not generated. The evaporation of the fluid film becomes active as the cylinder pressure becomes lower. Accordingly, the flash boiling upper limit temperature Tf2 becomes lower as the intake pressure becomes lower (that is, as the intake negative pressure becomes larger).

The engine controller 31 has a map or an expression of a relationship between the intake pressure, and the flash boiling lower limit temperature Tf1 and the flash boiling upper limit temperature Tf2 as shown in FIG. 8. At step 2, the flash boiling upper limit temperature Tf1 and the flash boiling upper limit temperature Tf2 corresponding to the sensed intake pressure are determined. It is judged whether or not the fuel temperature Tf estimated at step 1 is between the flash boiling lower limit temperature Tf1 and the flash boiling upper limit temperature Tf2. When the fuel temperature Tf estimated at step 1 is between the flash boiling lower limit temperature Tf1 and the flash boiling upper limit temperature Tf2, a flag fFB indicative of the satisfaction of the flash boiling condition is set to "1". When the fuel temperature Tf is lower than the flash boiling lower limit temperature Tf1, or higher than the flash boiling upper limit temperature Tf2, the flag fFB is set to "0".

Subsequently to step 2, at step 3, the temperature of intake valve 4 (the intake valve temperature TV) is estimated (that is, calculated) from the various parameters at this time. For example, the fuel temperature is estimated by using at least one of the cooling water temperature, the fuel injection amount (corresponding to the input heat amount at each cycle), the engine speed, the engine load, and the air fuel ratio which relate to the intake valve temperature Tv. FIG.

Figure 12:
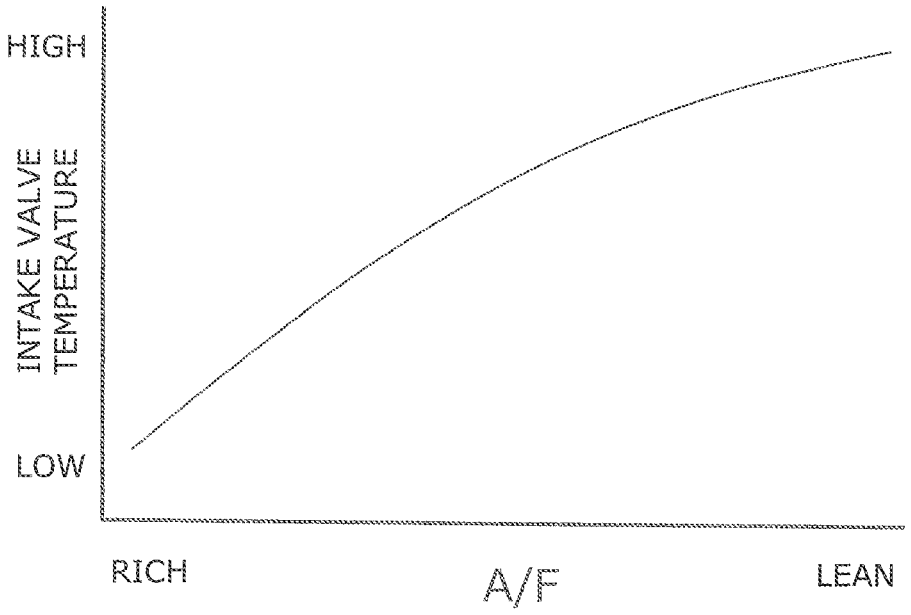
FIG. 12 is a characteristic view showing a relationship between the air fuel ratio and the intake valve temperature.

9 to FIG. 12 show relations between the respective parameters and the intake valve temperature Tv. The intake valve temperature Tv becomes higher as the cooling water temperature, the fuel injection amount, or the load becomes higher. Moreover, the heat amount per unit time becomes higher as the rotation speed becomes higher. Accordingly, it is estimated that the intake valve temperature Tv becomes higher as the rotation speed becomes higher. Moreover, when the air fuel ratio is rich, the combustion temperature is lowered. Consequently, it is estimated that the intake valve temperature Tv becomes lower as the air fuel ratio becomes richer. In one example, a basic value of the intake valve temperature Tv is determined by using a map previously prepared from the cooling water temperature and the fuel injection amount (or the load). The basic value is corrected by the engine speed and the air fuel ratio. With these, the intake valve temperature Tv is estimated.

Subsequently to step 3, at step 4, the intake valve temperature Tv estimated at step 3 is compared with the above-described intake valve threshold temperature Tv0. The intake valve threshold temperature Tv0 is previously set to a temperature at which the fuel spray injected from the port injection fuel injection valve 12 does not form the fluid film on a surface of the intake valve 4. The intake valve threshold temperature Tv0 may be a fixed value, or a value corrected based on the intake pressure and so on.

When the intake valve temperature Tv is equal to or smaller than the intake valve threshold temperature Tv0, the process proceeds from step 4 to step 5. The flag fFB indicative of the flash boiling condition is judged.

When the flag fFB is "0" (that is, the flash boiling condition is not satisfied), the process proceeds from step 5 to step 6. The GDI injection ratio is increased. Besides, at the initial stage, the GDI injection ratio is 100(%). That is, the in-cylinder injection fuel injection valve 16 which is advantageous in the fuel consumption rate and so on is a default fuel injection valve.

At step 5, when the flag fFB is "1" (that is, the flash boiling condition is satisfied), the process proceeds from step 5 to step 7. The MPI injection ratio is increased (the GDI injection ratio is decreased accordingly). For example, the injection ratio is varied by a constant amount such as 1% or 5%. As described above, the routine shown in the flowchart of FIG. 2 is repeatedly performed at each combustion cycle of each cylinder. Accordingly, when the state where the intake valve temperature Tv is equal to or smaller than the intake valve threshold temperature Tv0, and where the flash boiling condition is satisfied is continued, the MPI injection ratio is gradually increased, so that the MPI injection ratio becomes 100(%).

Moreover, when the flag fFB becomes "0" by the variation of the parameters after the flash boiling condition is satisfied and the MPI injection ratio becomes 100(%) or an appropriate intermediate value, the process proceeds from step 5 to step 6. The GDI injection ratio is increased. The state of "0" of the flag fFB is continued, the GDI injection ratio is gradually increased, so that the GDI injection ratio becomes 100(%).

At step 4, when the intake valve temperature Tv exceeds the intake valve threshold temperature Tv0, the process proceeds from step 4 to step 8. The fuel temperature Tf at the tip end portion of the in-cylinder injection fuel injection valve 16 is compared with the flash boiling upper limit temperature Tf2. When the fuel temperature Tf is equal to or smaller than the flash boiling upper limit temperature Tf2, the process proceeds to step 7. The MPI injection ratio is increased. That is, when the intake valve temperature Tv exceeds the intake valve threshold temperature Tv0, the fuel injected from the port injection fuel injection valve 12 does not become the fluid film in the intake valve 4. Accordingly, the MPI injection ratio is increased irrespective of the flash boiling condition.

At step 8, when the fuel temperature Tf exceeds flash boiling upper limit temperature Tf21, the process proceeds to step 6. The GDI injection ratio is increased to suppress the knocking.

Figure 13:
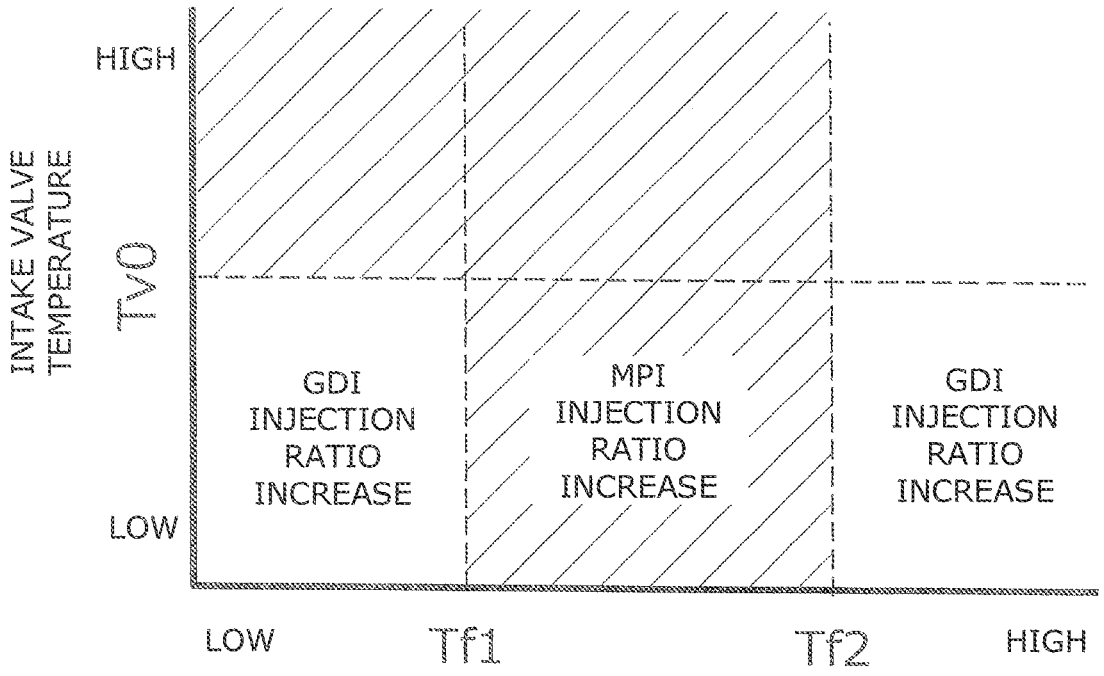
FIG. 13 is an explanation view showing whether the GDI injection ratio or the MPI injection ratio is the increase side, based on the fuel temperature and the intake valve temperature.

FIG. 13 is an explanation view showing whether the GDI injection ratio or the MPI injection ratio is the increase side, based on the fuel temperature Tf and the intake valve temperature Tv by the operations of step 4 to step 8. The MPI injection ratio is increased in a region shown by oblique lines in the drawing. The GDI injection ratio is increased in the other region.

In this way, in this embodiment, the GDI injection ratio and the MPI injection ratio are variably controlled based on the flash boiling condition. The PN increase due to the flash boiling is avoided.

Figure 14:
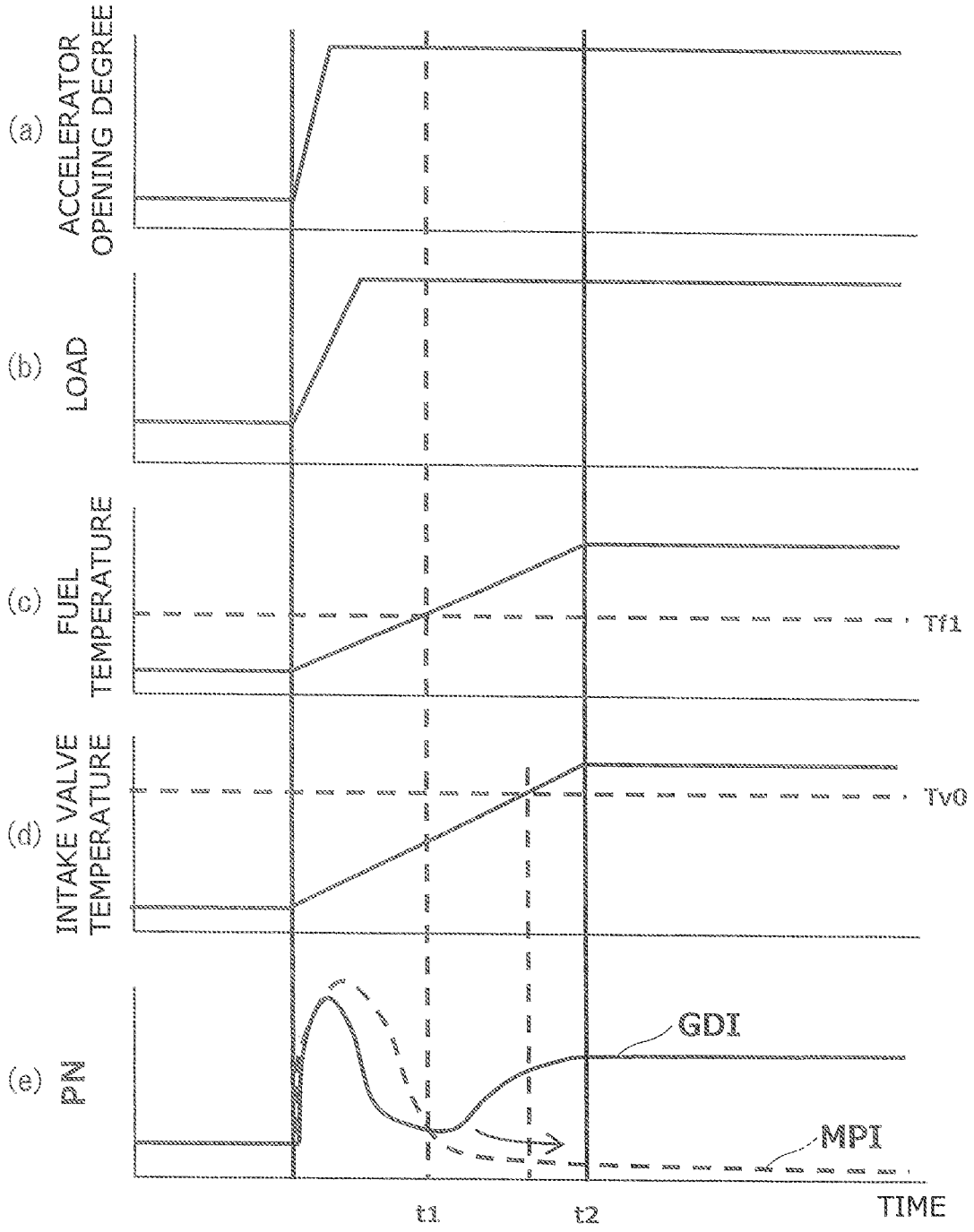
FIG. 14 are time charts showing variations of the PN value and so on at an acceleration.

FIG. 14 is a time chart showing one example when the internal combustion engine 1 is accelerated from the point P1 to the point P2 in FIG. 8. In the drawing, (a) shows the variation of the accelerator opening degree. (b) shows the variation of the engine speed and the engine load. (c) shows the variation of the fuel temperature Tf. (d) shows the variation of the intake valve temperature Tv. (e) shows the variation of the PN values of the GDI and the MPI.

As shown in the drawing, when the accelerator opening degree is increased, and when the engine speed and the engine load are increased, the fuel temperature Tf and the intake valve temperature Tv are gradually increased. In the example shown in the drawing, the fuel temperature Tf exceeds the flash boiling lower limit temperature Tf1 at time t1. The intake valve temperature Tv exceeds intake valve threshold temperature Tv0 at time t2.

The PN value by the GDI which is the default fuel injection valve is temporarily increased when the engine load is increased as shown by a solid line. Then, the PN value by the GDI is decreased. When the flash boiling is generated in accordance with the increase of the fuel temperature Tf, the PN value becomes high. On the other hand, the PN value by the MPI is also temporarily increased when the engine load increased as shown by a dotted line. At this time, the PN value by the MPI is higher than the PN value by the GDI. However, the PN value by the MPI is gradually decreased in accordance with the increase of the wall temperature of the intake valve temperature Tv and so on.

In the above-described embodiment, at time t1, the characteristic is shifted from the characteristic of the PN value by the GDI shown by the solid line, to the characteristic of the PN value by the MPI shown by the dotted line. With this, it is possible to suppress the PN value to a minimum as a whole.

Besides, in this embodiment, when the fuel temperature Tf exceeds the flash boiling lower limit temperature Tf1, the increase of the MPI injection ratio is rapidly started. However, there is some delay (a little delay) for the variation of the PN value. When the increasing fuel temperature Tf exceeds the flash boiling upper limit temperature Tf2, or when the decreasing fuel temperature Tf becomes lower than flash boiling upper limit temperature Tf2 and the flash boiling lower limit temperature Tf1, there is also some delay for the characteristic variation of the PN value.

Figure 15:
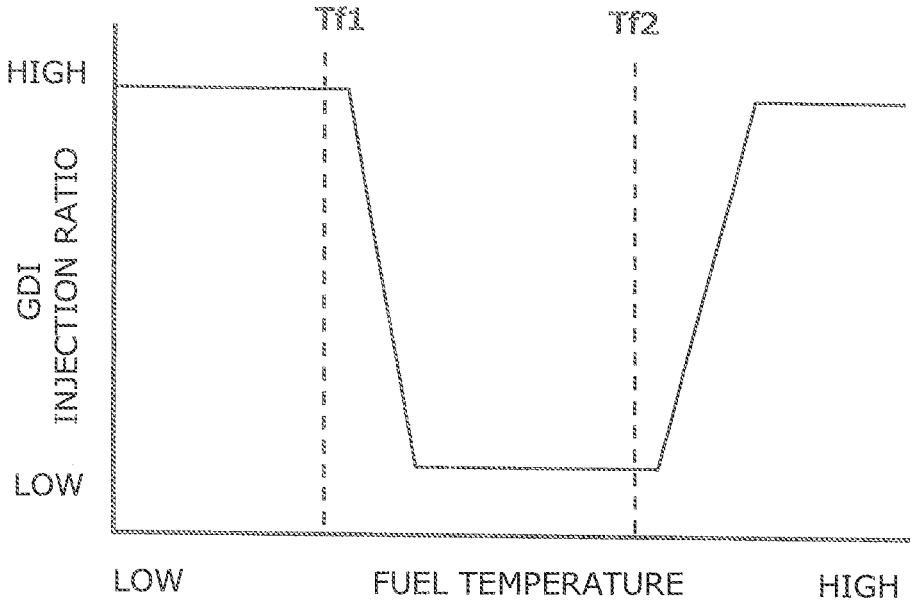
FIG. 15 is an explanation view showing an example in which a hysteresis is provided.

Accordingly, an appropriate hysteresis may be provided to the temperature threshold value in accordance with the direction of the temperature variation, in consideration with the above-described delay. FIG. 15 shows one example of the hysteresis at the increase of the temperature.

Figure 16:
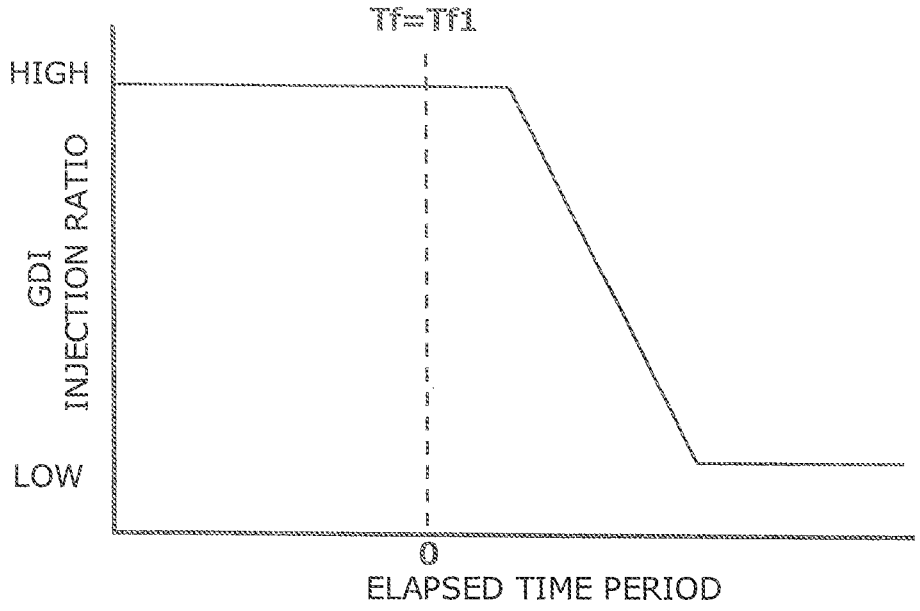
FIG. 16 is an explanation view showing an example in which a delay time period is provided.
Figure 17:
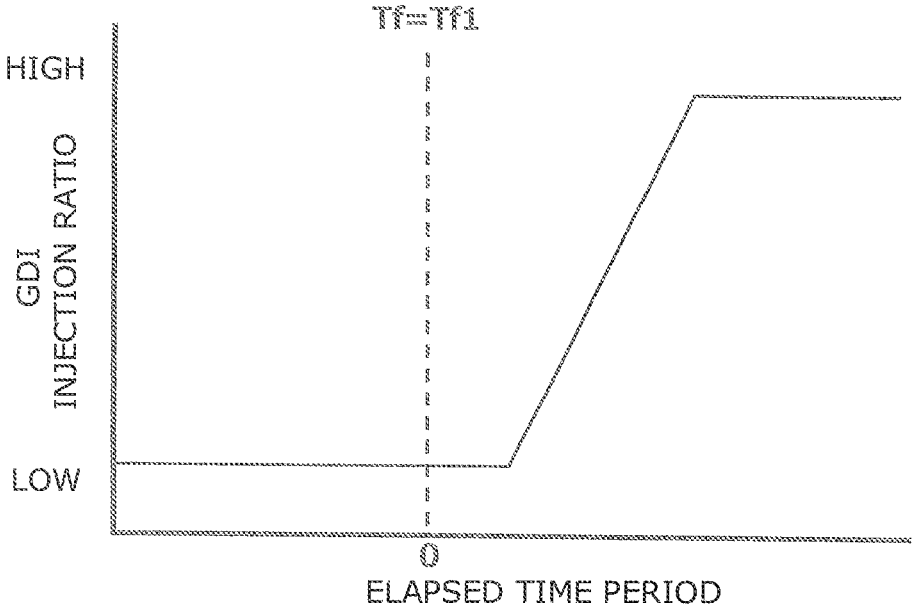
FIG. 17 is an explanation view showing another example in which a delay time period is provided.

Alternatively, an appropriate delay time period may be provided until the variation of the injection ratio is started after the fuel temperature Tf passes across the temperature threshold value, in place of the temperature hysteresis. FIG. 16 shows one example of the delay time period from when the fuel temperature Tf passes across the flash boiling lower limit temperature Tf1 at the increase of the temperature. FIG. 17 shows one example of the delay time period when the temperature is lowered from the temperature higher than the flash boiling lower limit temperature Tf1 to be lower than the flash boiling lower limit temperature Tf1.

Moreover, in this embodiment, the fuel temperature Tf at the tip end portion of the in-cylinder injection fuel injection valve 16, and the intake valve temperature Tv are estimated from the various parameters. However, these may be sensed by using the temperature sensor.

The invention claimed is:

1. A control method of an internal combustion engine including an in-cylinder injection fuel injection valve arranged to inject a fuel to a combustion chamber, and a port injection fuel injection valve arranged to inject the fuel to an intake port, the control method comprising:

sensing or estimating a fuel temperature at a tip end portion of the in-cylinder injection fuel injection valve;

sensing an intake pressure;

judging whether or not a flash boiling condition in which a flash boiling condition may be generated is satisfied, based on the fuel temperature and the intake pressure;

setting the in-cylinder fuel injection valve to a default fuel injection valve; and injecting an entire or a part of the fuel from the port injection fuel injection valve by decreasing an injection amount ratio of the in-cylinder injection fuel injection valve when the flash boiling condition is satisfied.

2. The control method of the internal combustion engine as claimed in claim 1, wherein a flash boiling lower limit temperature and a flash boiling upper limit temperature are previously set in accordance with the intake pressure; and when the sensed or estimated fuel temperature is between the flash boiling lower limit temperature and the flash boiling upper limit temperature which correspond to the sensed intake pressure, it is judged that the flash boiling condition is satisfied.

3. The control method of the internal combustion engine as claimed in claim 2, wherein an intake valve temperature is sensed or estimated; and when the intake valve temperature exceeds an intake valve threshold temperature by which a generation of a fluid film due to the fuel injected from the port injection fuel injection valve is avoided, and when the fuel temperature does not exceed the flash boiling upper limit temperature, the entire or the part of the fuel is injected from the port injection fuel injection valve by decreasing the injection amount ratio of the in-cylinder injection fuel injection valve, irrespective of the flash boiling condition.

4. The control method of the internal combustion engine as claimed in claim 3, wherein when the fuel injection valve exceeds the flash boiling upper limit temperature, the injection amount ratio of the in-cylinder injection fuel injection valve is increased.

5. The control method of the internal combustion engine as claimed in claim 1, wherein the fuel temperature is estimated by using at least one of a water cooling temperature, a fuel injection amount, an engine speed, an engine load, and an air fuel ratio which relate to the fuel temperature at the tip end portion of the in-cylinder injection fuel injection valve.

6. A control device of an internal combustion engine including an in-cylinder injection fuel injection valve arranged to inject a fuel to a combustion chamber, and a port injection fuel injection valve arranged to inject the fuel to an intake port, the in-cylinder injection fuel injection valve being a default fuel injection valve, the control device comprising:

the control device being configured to variably control an injection amount ratio of the in-cylinder injection fuel injection valve, and an injection amount ratio of the port injection fuel injection valve in accordance with a condition, to sense or estimate a fuel temperature at a tip end portion of the in-cylinder injection fuel injection valve, and to sense an intake pressure, and when it is judged that a flash boiling condition in which a flash boiling may be generated is satisfied, based on the fuel temperature and the intake pressure, the control device being configured to decrease the injection amount ratio of the in-cylinder injection fuel injection valve, and to increase the injection amount ratio of the port injection fuel injection valve.

* * * * *